United States Patent [19]

Thompson-Russell

[11] Patent Number: 4,859,901

[45] Date of Patent: Aug. 22, 1989

[54] COLOR CRT SHADOW MASK WITH WRINKLE-FREE CORNERS

[75] Inventor: Kathryn C. Thompson-Russell, Eindhoven, Netherlands

[73] Assignee: U.S. Philips Corporation, New York, N.Y.

[21] Appl. No.: 785,085

[22] Filed: Oct. 3, 1985

Related U.S. Application Data

[63] Continuation of Ser. No. 688,279, Jan. 3, 1985, abandoned, which is a continuation of Ser. No. 437,087, Oct. 27, 1982, abandoned.

[30] Foreign Application Priority Data

Oct. 29, 1981 [NL] Netherlands ..... 8104894

[51] Int. Cl.[4] ..... H01J 29/06

[52] U.S. Cl. ..... 313/403; 313/407

[58] Field of Search ..... 313/402, 407, 403, 408

[56] References Cited

U.S. PATENT DOCUMENTS

| | | | |
|---|---|---|---|
| 3,737,703 | 6/1973 | Tsuneta et al. | 313/407 |
| 3,809,945 | 5/1974 | Roeder | 313/402 |
| 3,862,448 | 1/1975 | Ishizuka et al. | 313/402 |
| 4,191,909 | 3/1980 | Dougherty | 313/402 |

FOREIGN PATENT DOCUMENTS

| | | | |
|---|---|---|---|
| 52-57776 | 5/1977 | Japan | 313/402 |
| 54-55366 | 5/1979 | Japan | 313/403 |

*Primary Examiner*—Donald J. Yusko
*Assistant Examiner*—Sandra L. O'Shea

[57] ABSTRACT

A deep-drawn rectangular shadow mask having a blind edge between the aperture area and the upright skirt. In each corner of the blind edge, weakened portions are formed extending parallel to the diagonal of the mask, to compensate for the buckle load occurring during bilateral drawing of the mask. The weakened portions are formed by rows of elongated pits parallel to the corner diagonal, or blind slots parallel to the diagonal.

13 Claims, 5 Drawing Sheets

COLOR CRT SHADOW MASK WITH WRINKLE-FREE CORNERS

This is a continuation of application Ser. No. 688,279, filed Jan. 3, 1985, now abandoned, which is a continuation of Ser. No. 437,087, filed on Oct. 27, 1982, now abandoned.

BACKGROUND OF THE INVENTION

The invention relates to a color display tube comprising, in a glass envelope with a substantially rectangular display window having a pattern of phosphors which can luminesce in different colors when struck by electron beams, a system of electron guns for generating a number of electron beams directed on the display window, and a substantially rectangular shadow mask comprising a mask sheet having an upright edge; and more particularly to such a CRT whose mask, within a blind edge, has a pattern of apertures, and which has weakened portions provided in the blind edge.

Such a color display tube is known from U.S. Pat. No. 3,809,945. This patent relates to a so-called delta tube in which the electron guns for the three electron beams are located at the corners of a triangle. Phosphor dots luminescing in the colors red, green and blue are provided on the display window in a pattern at the corners of triangles. A shadow msk is located inside the tube, a short distance from the display window. The mask is formed by a supporting frame and a mask sheet connected thereto by means of its upright edge. The mask sheet has, between the pattern aea and the upright edge, a blind edge which thus surrounds the pattern of circular apertures which associate each electron beam with luminescent phosphor dots of one color.

Such a mask sheet is manufactured from a flat steel plate in which the pattern of circular apertures is etched. The mask sheet is then deep drawn to its ultimate dish shape by means of a stretch forming process. In this process, the mask sheet is clamped along its circumference at the four rectangle sides and is stretched over a die. During and after stretching, the edge of the mask sheet is bent over. During stretch forming, the mask sheet material is stretched to beyond its elastic limit so that the mask sheet is permanently deformed.

Within the area of the pattern of apertures, the mask sheet is weaker than at the area of the blind edge. As a result of this sharp transition in tensile strength, the mask material, during the stretch forming process, is stretched excessively at the edge of the pattern of apertures, in particular, in the corners of the mask sheet. As a result, the apertures are deformed at the edge of the pattern. In the corners of the mask sheet, the material of the mask may even be stretched to such an extent that cracks occur in the mask material. In order to prevent this, weakened areas are provided around the pattern of apertures and form a transition between the blind edge having a comparatively large tensile strength and the pattern of apertures having a comparatively small tensile strength. The weakened portions are formed by a number of circular pits which form a continuation of the actual pattern of apertures. The width of the pattern of pits decreases from the corners towards the centers of the sides of the mask sheet.

In the usual present day color display tubes, the electron guns are no longer situated at the corners of a triangle but they are located in one plane (in-line). In these tubes, vertical phosphor lines capable of luminescing in the colors red, green and blue are provided alternately on the display screen. The shadow mask sheet has a pattern of rows of elongate apertures with small bridges between the apertures. Such a mask sheet has a much larger strength in the direction of the rows of apertures than in the direction at right angles to the rows of apertures. A stretch forming process as is used for mask sheets having circular apertures is consequently not suitable for mask sheets having rows of elongate apertures, because in such a process the bridges between the apertures would break.

A so-called bilateral or uniaxial drawing process is usually used for stretch forming mask sheets having rows of elongate apertures. Such a process is disclosed in German Patent Specification No. 2,628,894. During stretch forming the mask sheet, the two long rectangle sides are clamped between a drawing ring and a blank holder. These rectangle sides are perpendicular to the direction of the rows of apertures, that is to say perpendicular to the direction in which the mask sheet has its largest strength. On the short rectangle sides, the mask sheet is not clamped but there is some space between the blank holder and the drawing ring. During stretch forming over a die, the mask material is stretched in the direction of its largest strength. In the direction of the smaller strength the mask material is stretched to a much smaller extent, due to the permitted slip of the short rectangle sides between the drawing ring and the die.

As a result of this bilateral stretch forming process, however, undulations or wrinkles occur in the corners of the blind edge of the mask sheet which influence the pattern of apertures. This formation of wrinkles occurs because, in the bilateral stretch forming process, as contrasted with the unilateral stretch forming process, no excessive tensile loads but an excessive buckle load occurs in the corners of the mask sheet. This buckle load is such that wrinkles are formed which extend parallel to the diagonal in the each corner of the mask sheet. These undulations influence the pattern of the rows of elongate apertures. The apertures situated on these undulations thus have a different distance to the phosphor lines on the display screen and have a different effective area with respect to the electron beams. These differences cause a reduced landing tolerance and color defects.

SUMMARY OF THE INVENTION

The object of the invention is to provide a shadow mask for a color display tube which avoids disadvantageous effects on the pattern of apertures as a result of the bilateral stretch forming process. In accordance with the invention, in a color display tube or CRT having a mask with rows of elongate apertures, the weakened portions are provided mainly in each corner of the mask sheet in such manner that in each corner the blind edge is weaker in a direction transverse to the diagonal of the mask sheet than in a direction parallel to that diagonal. By weakening the blind edge in the direction in which, during the bilateral drawing process, the forces resulting from the buckle load are situated, a wrinkle zone is obtained which absorbs the buckle load. As a result, the formation of wrinkles in the corners is prevented and, hence, the occurrence of irregularities in the shape of the elongate apertures is also prevented.

A first embodiment is characterized in that the weakened portions are formed by staggered rows of somewhat elongate pits or slots extending substantially parallel to the diagonal of the mask sheet in the relevant corner, the longituidnal direction of these pits being substantially parallel to that diagonal. At the aea of the pits the mask sheet has a smaller thickness and hence has a smaller strength. The buckle load occurring in the bilateral stretch forming process is compensated for by the pits which are deformed at right angles to their longitudinal direction. As a result the formation of wrinkles in the corners of the mask sheet is prevented.

A second embodiment is characterized in that the weakened portions are formed by a number of elongated blind slots whose longitudinal direction is substantially parallel to the diagonal in the relevant corner. The blind slots absorb the buckle load and are deformed at right angles to their longitudinal direction.

A third embodiment is characterized in that the width of the blind slots increases from the upright edge of the mask sheet towards the pattern of elongate apertures. As a result of the increasing width of the blind slots, the weakening of the blind edge increases in the direction towards the pattern of apertures. This causes a gradual transition between the strength of the mask sheets at the area of the pattern of apertures and the mask edge at the area of the weakened portions.

A further embodiment is characterized in that the weakened portions are present on the side of the mask sheet facing the display window. As is known, the apertures in the mask sheet have a so-called tapered cross-section so as not to decrease the width of the apertures for the electron beams in the case of oblique incidence of the beams. This tapered cross-section is obtained by means of a bilateral etching process in which pits are etched on both sides of the mask. In this process, larger and deeper pits are etched on the side facing the display window than on the opposite side. By providing the weakened portions on the side facing the display window and etching simultaneously with the pits for the apertures, comparatively deep pits are obtained and hence a comparatively large weakening.

Still a further embodiment is characterized in that weakened portions are also present on the side of the mask sheet remote from the display window. By providing weakened portions on both sides of the mask sheet, a still larger weakening is obtained. The weakened portions on the side of the mask sheet remote from the display window may be present opposite to the weakened portions on the side facing the display window. During etching the weakened portions, etching is not continued until apertures are formed.

Still a further embodiment is characterized in that the weakened portions on the side remote from the display window are present between the weakened portions on the side facing the display window. The weakened portions on both sides can be etched simultaneously with the pits for the apertures for the electron beams.

Still another embodiment is characterized in that a face bed or ridge is provided near the outer circumference of the blind edge of the mask sheet. Providing such a face bead prevents the part of the mask sheet present within the face bead from being deformed when the edge of the sheet is bent over. It has been found that the provision of a face bead also contributes to smoothing undulations possibly present in the corners of the blind edge after stretching the mask sheet.

The weakened portions are preferably provided by means of etching. However, the weakened portions may alternatively be obtained by milling or punching, and the like.

The invention will be described in greater detail, by way of example, with reference to the accompanying drawings.

DESCRIPTION OF THE PREFERRED EMBODIMENTS

Figure 1:
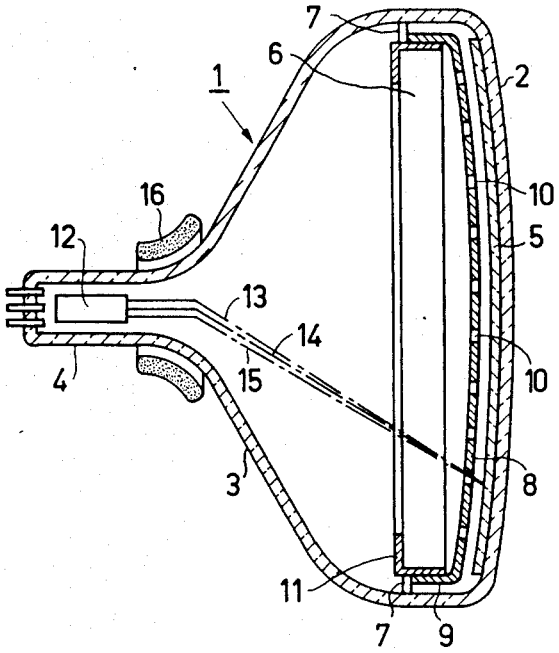
FIG. 1 is a diagrammatic sectional view of a color display tube.

The color display tube 1 shown in FIG. 1 has a glass envelope which has a rectangular display window 2, a cone 3 and a neck 4. A pattern of phosphor lines 5, capable of luminescing alternately in the colors red, green and blue is provided on the display window 2. At a short distance from the display window 2, a shadow mask 6 is connected by means of suspension numbers 7 shown diagrammatically. The shadow mask 6 is formed by a mask sheet 8 having a thickness of approximately 0.15 mm. The mask sheet 8 has an upright edge 9 and a large number of rows of apertures 10. The mask sheet 8 is curved substantially in accordance with the shape of the display window 2. A mask ring 11 which gives the shadow mask 6 its rigidity is connected to the upright edge 9.

In the neck 4 of the tube, a system of electron guns 12 is mounted for generating three electron beams 13, 14 and 15 situated in one plane. These beams are deflected by means of a system of deflection coils 16 placed around the tube, and intersect each other substantially at the area of the shadow mask 6. Each of the electron beams impinges on one of the phosphors provided on the display screen 2.

Figure 2:
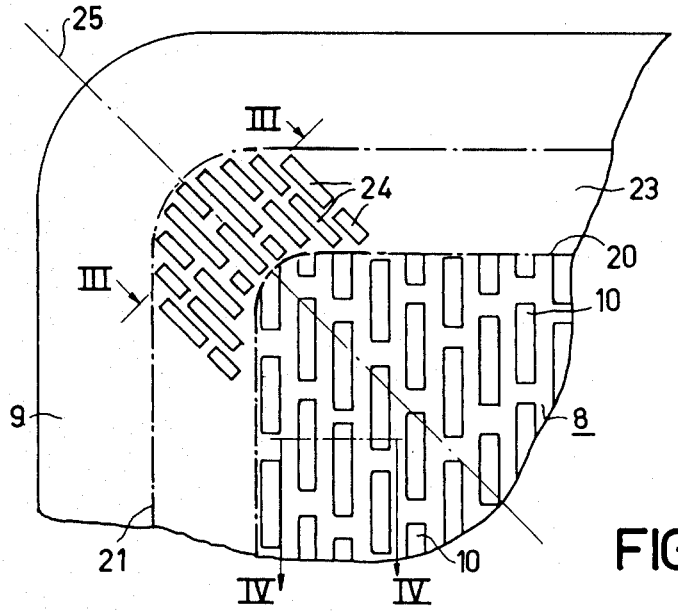
FIG. 2 is a plan view of a corner portion of the shadow mask of a first embodiment prior to stretch forming.

FIG. 2 shows a corner portion of the mask sheet 8 in a flat condition prior to stretch forming. The substantially rectangular mask sheet has a pattern of apertures within an area which is show by the dot-and-dash edge line 20. The pattern of apertures is formed by a large number of rows of elongate apertures 10. The apertures 10, for example, have a length of 0.66 mm and a width of 0.19 mm. The width of the bridges between the apertures 10 is, for example 0.11 mm and the pitch between the rows of apertures 10 is, for examples, 0.77 mm. The part of the mask sheet 8 which, during deep-drawing, is bent over and form the upright edge 9 is indicated by the imaginary folding line 21. The part of the mask sheet 8 between the lines 20 and 21 forms a blind edge 23 of the pattern of apertures. In the corner of this blind edge 23, a pattern of pits is formed. This pattern is formed by a number of staggered rows of small, somewhat elongate pits or blind slots 24, whose longitudinal direction is parallel to te diagonal 25 of the mask sheet 8. The pits or blind slots 24 have, for example, a length of 0.50 mm and a width of 0.35 mm. The pitch between the apertures and the rows of apertures is, for example, 0.20 mm and 0.53 mm, respectively. The extent of weakening of the blind edge can be adjusted by the choice of the dimension of the pits, the pitch between the pits of a row, and the pitch between the rows of pits. In the example shown, the pitch between the rows of pits is constant. It is also possible to vary the pitch between the rows.

Figure 3:
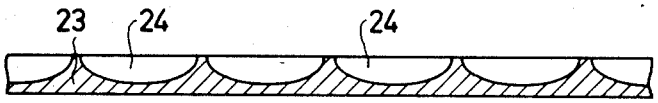
FIG. 3 is a sectional view taken on the line III—III of FIG. 2.

FIG. 3 is a sectional view taken on the line III—III at right angles to the diagonal 25 show in FIG. 2. As is visible in the drawing, the mask sheet 8 at the area of the pits 24 has a smaller thickness and hence a smaller strength. Because the pits 24 are elongate and are provided in staggered rows extending parallel to the diagonal 25, the blind edge 23 is weaker in a direction at right angles to the diagonal 25 than in a direction parallel to the diagonal 25.

Figure 4:
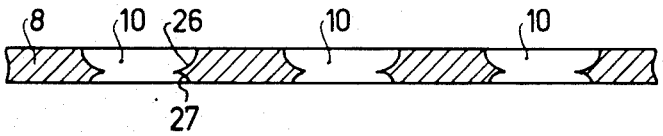
FIG. 4 is a sectional view taken on the line IV—IV of FIG. 2.

The pits or blind slots 24 are preferably etched in the mask sheet 8 simultaneously with the etching of the apertures 10. According to common practice in the color CRT art, the apertures 10 in the mask sheet 8 have a tapered shape, as shown in FIG. 4 which is a sectional view taken on the line IV—IV of FIG. 2. The tapered shape of the apertures 10 is necessary so as not to decrease the effective width of the apertures 10 for the electron beams in the case of oblique incidence of the electron beams. The apertures 10 are formed by two elongated pits 26 and 27 intersecting with each other. The pits 26 are made on the side of the mask sheet facing the display window 2 and are larger and deeper than the pits 27 on the other side. These apertures 10 are provided by means of a so-called bilateral etching process in which the larger and deeper pits 26 are etched during a first phase and the pits 27 are etched during a second shorter phase. By providing the pits 24 in the blind edge 23 on the side facing the display window 2 and etching simultaneously with the pits or blind slots 26, deep pits 24 are obtained and, hence, a comparatively large weakening of the blind edge 23. It is also possible to provide weakenings by etching pits on both sides of the mask sheet, this etching being discontinued before apertures are formed. By such a process an even larger weakening can be obtained.

Figure 5:
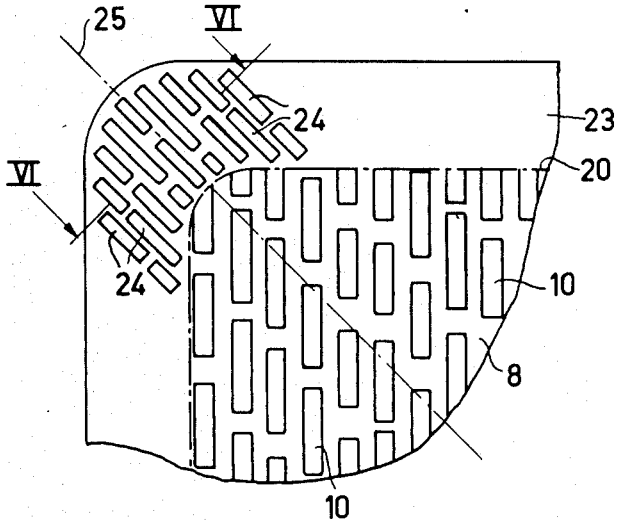
FIG. 5 is a plan view of the corner portion of the shadow mask shown in FIG. 2 after deep drawing.

The stretch forming of the mask sheet 8 occurs by means of a bilateral drawing process. In this process the mask sheet 8 is clamped on its two long rectangle sides which are at right angles to the longitudinal direction of the rows of apertures 10. The mask sheet 8 is stretched over a die, the edge 9 of the mask sheet 8 being bent over. FIG. 5 is a plan view of a corner of the mask sheet after deep drawing. During stretch forming the mask sheet 8 is mainly stretched in the direction of the rows of apertures 10, that is to say in the direction of its largest strength. In the direction of its smallest strength, the mask material is stretched to a much smaller extent due to the permitted slipping of the short rectangle sides of the mask edge during stretch forming.

Figure 6:
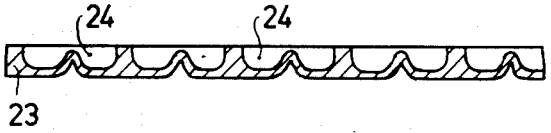
FIG. 6 is a sectional view taken on the line VI—VI of FIG. 5.

During the bilateral stretch forming process a buckle load occurs in the corners of the mask sheet 8 in a direction at right angles to the diagonal 25. However, this buckle load is absorbed by the rows of pits 24, which deform at right angles to their longitudinal direction as shown in FIG. 6, which is a sectional view taken on the line VI—VI of FIG. 5. As a result the occurrence of wrinkles is prevented so that the mask sheet 8 remains flat.

Figure 7:
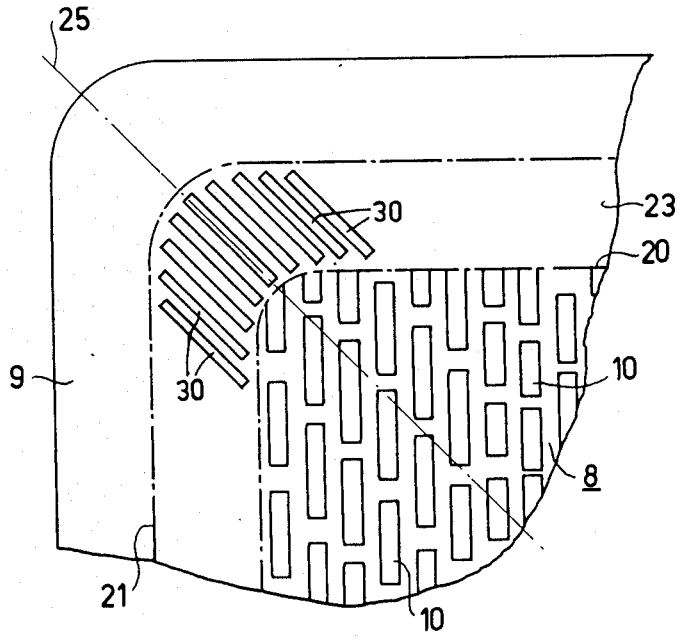
FIG. 7 is a plan view of a corner portion of the shadow mask of a second embodiment prior to stretch forming.

FIG. 7 shows a corner portion of the mask sheet of a second embodiment in the flat state prior to stretch-forming. The same components are referred to by the same reference numerals as in FIG. 2. The weakened portions in the corner of the blind edge 23 of the mask sheet 8 are formed by a number of slots 30 whose longitudinal direction is substantially parallel to the diagonal 23. The slots 30 extend substantially from the folding line 21 of the upright edge 9 up to the edge 20 of the pattern of apertures 10. Te slots 30 again absorb the buckle load occurring during stretch-forming and are deformed at right angles to their longitudinal direction.

Figure 8:
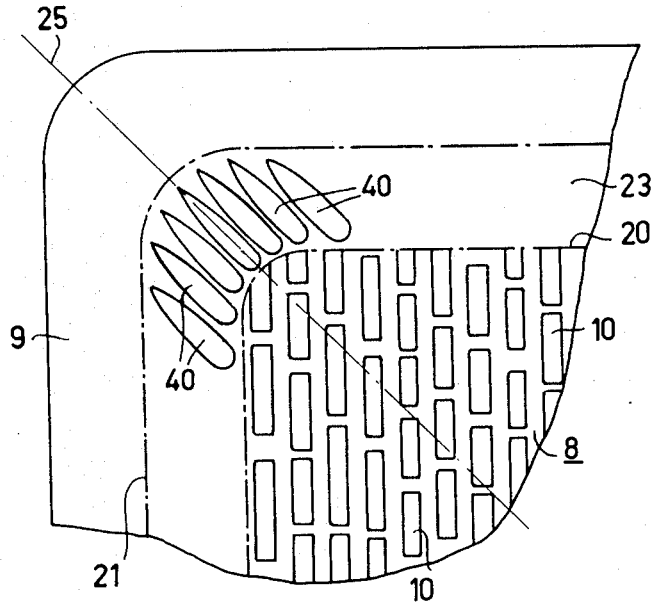
FIG. 8 is a plan view of a corner portion of the shadow mask of a third embodiment prior to stretch forming.

FIG. 8 shows a corner portion of the mask sheet of a third embodiment in the flat state prior to the stretch forming. The same components are again referred to by the same reference numerals as in FIG. 2. The weakened portions, as in FIG. 7, are formed by a number of blind slots 40 whose longitudinal direction is substantially parallel to the diagonal 25. The width of the slots 40, however, increases from the folding line 21 of the upright edge 9 towards the pattern of apertures 10. This increasing width provides a gradual transition in the strength of the mask sheet between the pattern of apertures 10 and the blind edge 23. The possibility of the occurrence of irregular deformations during stretch forming is thus prevented.

The weakened portions shown in FIGS. 7 and 8 are preferably provided by etching in a manner as was described with reference to FIG. 2.

Figure 9:
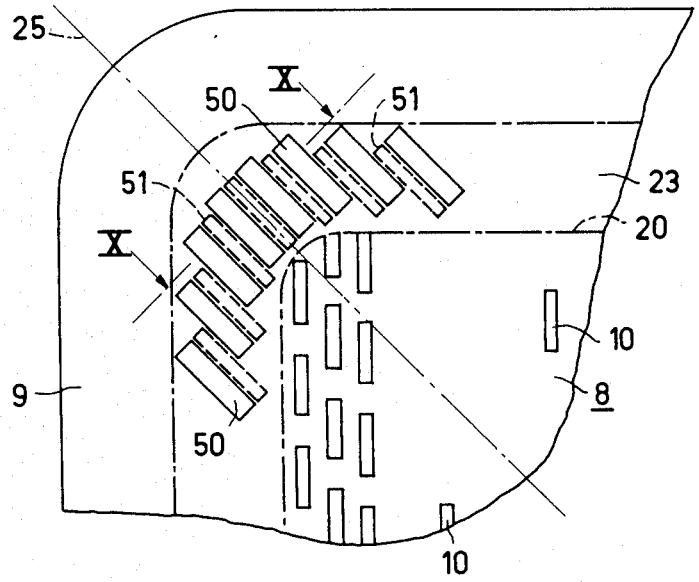
FIG. 9 is a plan view of a corner portion of the shadow mask according to a fourth embodiment prior to stretch forming.
Figure 10:
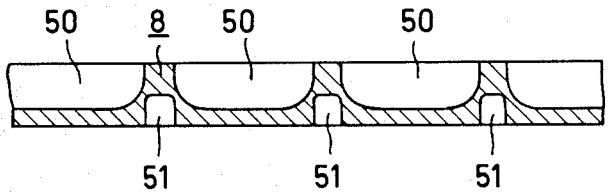
FIG. 10 is a sectional view taken on the line X—X of FIG. 9.

As already stated, a comparatively large weakening can be obtained by providing weakened portions on both sides of the mask sheet. A preferred embodiment hereof will be described in detail with reference to FIGS. 9 and 10. FIG. 9 shows a corner portion of the mask sheet in the flat condition prior to deep-drawing, and FIG. 10 is a sectional view taken on the line X—X of FIG. 9. The same components are referred to by the same reference numerals as in FIG. 2. The weakened portions on the side of the mask sheet 8 facing the display window are formed by a number of blind slots 50 whose the longitudinal direction is substantially parallel to the diagonal 25. A number of blind sots 51 whose longitudinal direction is parallel to the diagonal 25 are also present on the side of the mask sheet 8 remote from the display window. The slots 51 are positioned between the slots 50. The slots 50 are provided simultaneously with the first phase and the slots 51 are provided simultaneously with the second phase of the two-sided etching process.

Figure 11:
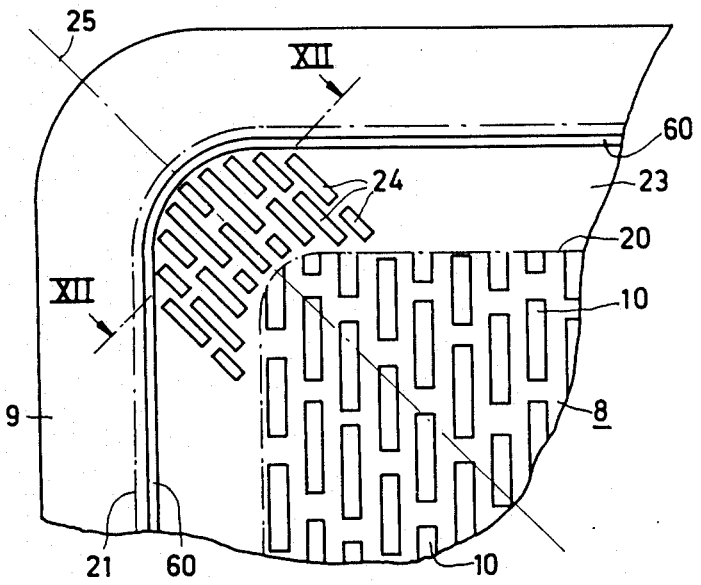
FIG. 11 is a plan view of a corner portion of the shadow mask according to a fifth embodiment prior to stretching.
Figure 12:
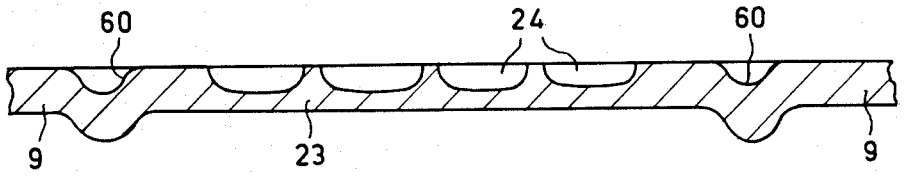
FIG. 12 is a sectional view taken on the line XII—XII of FIG. 11.

A fifth embodiment will be described with reference to FIGS. 11 and 12. FIG. 11 shows a corner position of the mask sheet in the flat condition prior to stretching and FIG. 12 is a sectional view taken on the line XII—XII of FIG. 11. The same components are referred to by the same reference numerals as in FIG. 2. The weakened portions are formed in the same manner as in FIG. 2. However, a face bead or ridge 60 is provided near the imaginary folding line 21 of the part 9 which is bent over during deep-drawing. The face bead 60 prevents the part of the mask sheet 8 present within the face bead 60 from deforming during deep-drawing the edge 9. It has been found that, after providing the face bead, the undulations possibly present after stretching the mask are smoothed for the greater part.

Although the invention has bee described with reference to a few embodiments, it will be obvious to those skilled in the art that many variations in the pattern of weakened portions are possible without departing from the scope of this invention.

What is claimed is:

1. A color cathode ray display tube, comprising a glass envelope having a substantially rectangular display window, and a pattern of phosphors capable of luminescing in different colors, arranged to be visible through said window, a system of electron guns for generating a plurality of electron beams directed onto said pattern, and a substantially rectangular shadow mask including a mask sheet having an upright edge, an area containing a pattern of apertures, and a blind edge between said area and said upright edge, said blind edge comprising weakened portions, characterized in that said pattern of apertures is formed by rows of elongate apertures, and said weakened portions are provided substantially in each corner only of the mask sheet, said portions being arranged with respect to a respective diagonal defined by the rectangular shadow mask such that said portions are weaker in a direction transverse to the respective diagonal than in a direction parallel to said diagonal.

2. A tube as claimed in claim 1, characterized in that said mask sheet comprises a face bead arranged adjacent an outer circumference of said blind edge.

3. A color cathode ray display tube, comprising a glass envelope having a substantially rectangular display window, and a pattern of phosphors capable of luminescing in different colors, arranged to be visbile through said window, a system of electron guns for generating a plurality of electron beams directed onto said pattern, and a substantially rectangular shadow mask including a mask sheet having an upright edge, an area containing a pattern of apertures, and a blind edge between said area and said upright edge, said blind edge comprising weakened portions, characterized in that said pattern of apertures is formed by rows of elongate apertures, and said weakened portions comprise staggered rows of elongated pits arranged in each corner of the mask sheet, said pits being elongated in a direction parallel to each other and to a respective diagonal defined by the rectangular shadow mask at that corner of the mask, said weakened portions thereby being weaker in a direction transverse to the respective diagonal than in a direction parallel to the respective diagonal.

4. A tube as claimed in claim 3, characterized in that said mask sheet comprises a face bead arranged adjacent an outer circumference of said blind edge.

5. A tube as claimed in claim 3, characterized in that said pits are formed on the side of the mask sheet facing the display window.

6. A tube as claimed in claim 5, characterized by comprising in addition staggered rows of said pits formed on the side of the mask sheet remote from the display window.

7. A tube as claimed in claim 6, characterized in that said rows of pits on the side remote from the display window are arranged between the rows of pits on the side facing the display window.

8. A color cathode ray display tube, comprising a glass envelope having a substantially rectangular display window, and a pattern of phosphors capable of luminescing in different colors, arranged to be visible through said window, a system of electron guns for generating a plurality of electron beams directed onto said pattern, and a substantially rectangular shadow mask including a mask sheet having an upright edge, an area containing a pattern of apertures, and a blind edge between said area and said upright edge, said blind edge comprising weakened portions, characterized in that said pattern of apertures is formed by rows of elongate apertures, and said weakened portions comprise a plurality of elongated blind slots arranged in each corner of the mask sheet, said slots being elongated in a direction parallel to each other and to a respective diagonal defined by the rectangular shadow mask at that corner of the mask, said weakened portions thereby being weaker in a direction transverse to the respective diagonal than in a direction parallel to the respective diagonal.

9. A tube as claimed in claim 8, characterized in that said mask sheet comprises a face bead arranged adjacent an outer circumference of said blind edge.

10. A tube as claimed in claim 8, characterized in that said blind shots each have a respective width which increases from said upright edge toward the area of said pattern of elongate apertures.

11. A tube as claimed in claim 10, characterized in that said blind slots are formed on the side of the mask sheet facing the display window.

12. A tube as claimed in claim 11, characterized by comprising in addition a plurality of said blind slots formed on the side of the mask sheet remote from the display window.

13. A tube as claimed in claim 12, characterized in that said blind slots on the side remote from the display window are arranged between the blind slots on the side facing the display window.

* * * * *